US005145437A

United States Patent [19]

Ondra et al.

[11] Patent Number: 5,145,437

[45] Date of Patent: Sep. 8, 1992

[54] FACEPLATE STRESS-RELIEF IN TENSION MASK COLOR CATHODE RAY TUBE MANUFACTURE

[75] Inventors: Jay D. Ondra, Forest Park; Paul R. Riopel, Elk Grove, both of Ill.

[73] Assignee: Zenith Electronics Corporation, Glenview, Ill.

[21] Appl. No.: 740,751

[22] Filed: Aug. 5, 1991

[51] Int. Cl.[5] ..... H01J 9/26

[52] U.S. Cl. ..... 445/45; 65/115; 65/41

[58] Field of Search ..... 445/8, 45; 65/41, 115, 65/117

[56] References Cited

U.S. PATENT DOCUMENTS

| | | | |
|---|---|---|---|
| 3,251,670 | 5/1966 | Acloque | 65/115 |
| 3,298,553 | 1/1967 | Lusher | 65/115 X |
| 4,498,884 | 2/1985 | Stover et al. | 445/45 |

*Primary Examiner*—Kenneth J. Ramsey

[57] ABSTRACT

An apparatus for use in the manufacture of a color cathode ray tube that includes a faceplate with a screen embraced by which rails support a flat tension mask. The apparatus includes a radiant heat source for heating the faceplate, and shielding means including a heat shield for shielding a central area of the faceplate from the radient heat source. Stresses induced in the corners of the faceplate by the rails during thermal cycling of the tube are dispersed in the cooler central area of the faceplate.

5 Claims, 3 Drawing Sheets

FACEPLATE STRESS-RELIEF IN TENSION MASK COLOR CATHODE RAY TUBE MANUFACTURE

CROSS-REFERENCE TO RELATED APPLICATIONS

This application is related to but in no way dependent upon copending application Ser. No. 458,129 filed Dec. 29, 1989.

BACKGROUND OF THE INVENTION

Field of the Invention

This invention relates to color cathode ray picture tubes, and is addressed specifically to an improved apparatus and method for use in the manufacture of tension mask rubes. The invention is useful in the manufacture of tension mask tubes of various types, including those used in home entertainment television receivers, and in medium-resolution and high-resolution tubes used in color monitors.

The tension mask is a part of the cathode ray tube front assembly, and is located in close adjacency to the faceplate. The front assembly comprises a faceplate including a screen having deposits of light-emitting phosphors, a shadow mask, and discrete shadow mask support means which extend from the faceplate. The support means, which may be composed of ceramic, metal, or a combination of both, are commonly termed "rails." The shadow mask is an apertured metallic foil which may, by way of example, be about 0.001 inch thick, or less. The mask must be supported in high tension a predetermined distance from the inner surface of the cathode ray tube faceplate, a dimension known as the "Q-distance."

The rails may comprise either four discrete sections or a single unitary structure. The design of the rails may conform to one of the several configurations described and claimed in U.S. Pat. No. 4,891,546, of common ownership herewith. The body of the rails shown is composed of a ceramic which is secured to the faceplate by devitrifying solder glass. A metal cap cemented to the ceramic provides a surface to which a flat tension mask can be welded. The cap also has a surface for deflecting a high-energy beam used to weld the mask to the cap.

If a cathode ray tube is to operate effectively, all gasses within envelope must be evacuated by heating the envelope to a high temperature for a predetermined period. At this stage of the production process, the tube is in a near-final stage of completion, that is, the screen has been deposited on the inner surface of the faceplate, the electron gun has been installed, and the faceplate assembly has been sealed to the funnel with devitrified solder glass.

In the evacuation process, the tube is exposed to a high temperature in a bake-out oven. The escape of gasses from the envelope as a result of the heating is assisted by a high-vacuum pump attached to a hollow glass tubulation that extends from the gun-end of the tube. When as near-perfect a vacuum as possible has been attained, the tubulation is sealed off, and the tube is allowed to cool. The final step in the evacuation process is to flash a "getter" within the envelope, which increases and maintains the vacuum level.

A certain percentage of the tubes will implode during the bake-out process. Such implosions are costly in terms of materials and labor, and every effort is made to hold the frequency of implosions to the smallest possible number.

A frequent cause of cracks leading to implosion was found to originate in the stresses in the faceplate induced at the ends of the mask-support rails that extend from the faceplate, and which are secured to the faceplate by devitrified solder glass. An analysis of the stresses induced in the faceplate by the rails is presented in application Ser. No. 458,129 filed Dec. 28, 1989, of common ownership herewith. The heating of the tube envelope during the bake-out cycle aggravates an otherwise latent stress condition, leading to the possible cracking of faceplates and consequent tube implosions.

OBJECTS OF THE INVENTION

It is a general object of the invention to provide apparatus and a method to facilitate the manufacture of flat tension mask color cathode ray tubes.

It is another object of the invention to provide savings in labor and cost in the manufacture of flat tension mask color cathode ray tubes.

It is a specific object of the invention to reduce the incidence of implosion in flat tension mask tubes subjected to the evacuation, bake-out cycle.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings (not to scale), in the several figures of which like reference numerals identify like elements, and in which:

DESCRIPTION OF THE PREFERRED EMBODIMENT

Figure 1:
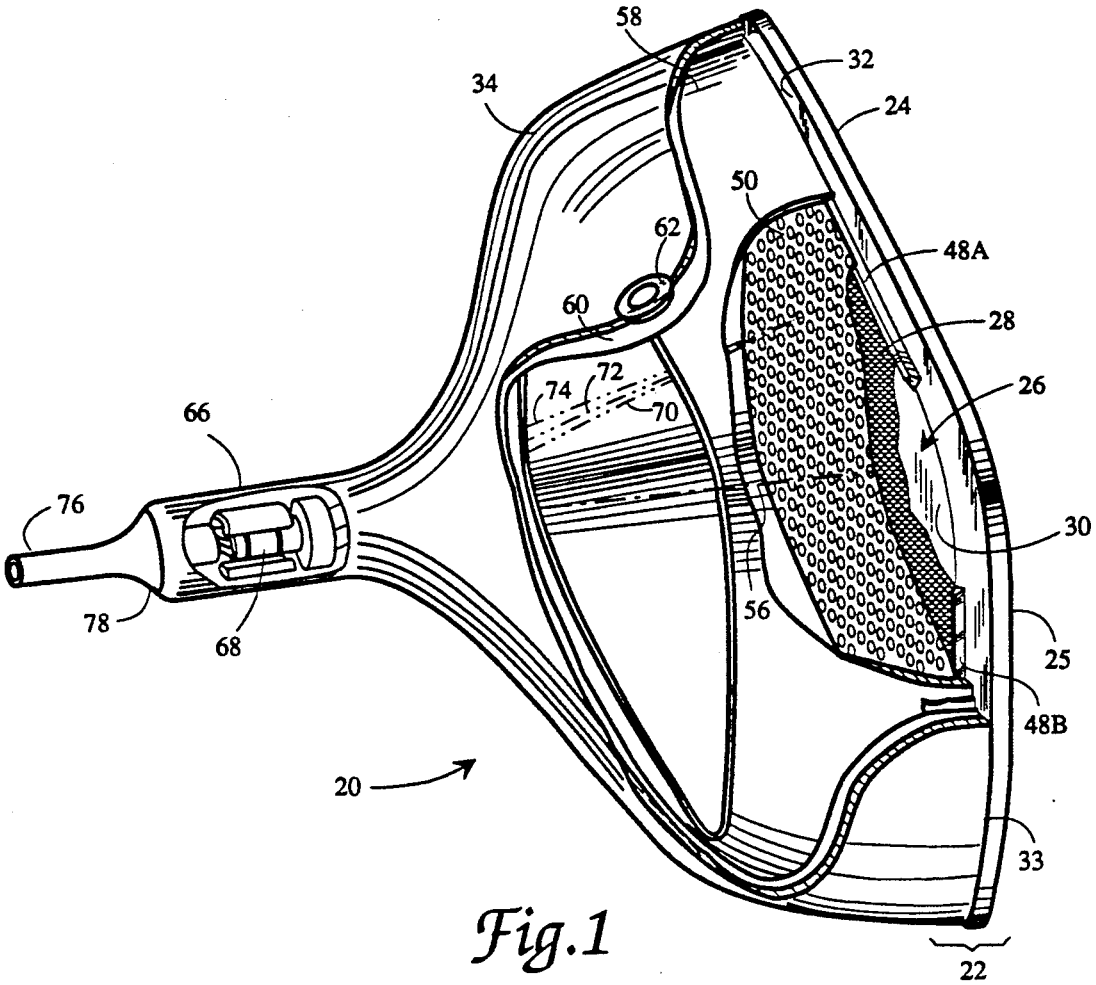
FIG. 1 is a side view in perspective of an in-process tension mask color cathode ray tube, with cutaway sections that indicate the location and relationship of the major components of the tube.
Figure 2:
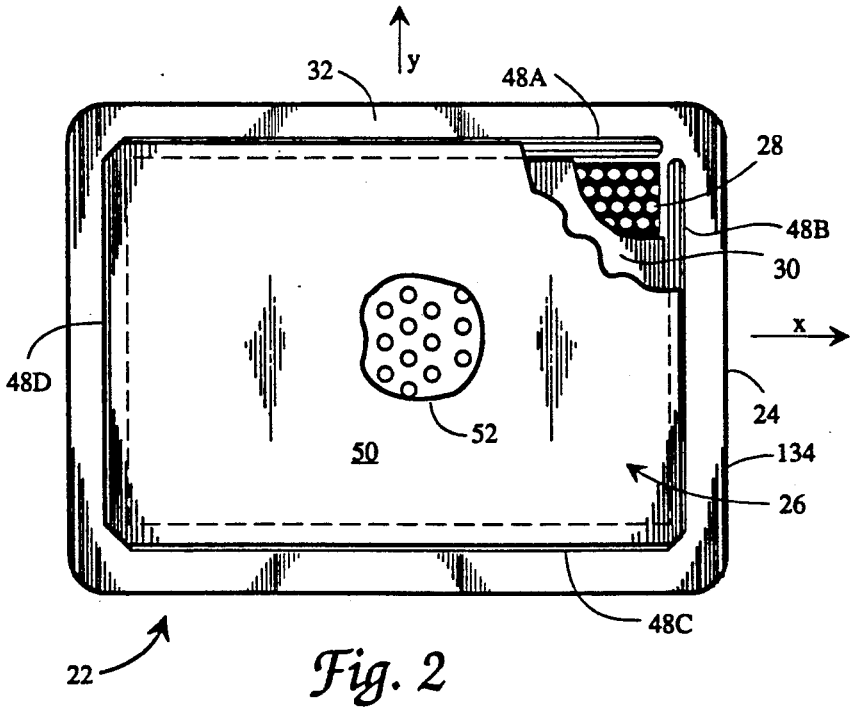
FIG. 2 is a plan view of the front assembly of the color cathode ray tube depicted in FIG. 1, with parts cut away to show the relationship of the faceplate, the rails that support the shadow mask, and the mask; insets show mask apertures and the phosphor screen pattern greatly enlarged.

The components of an in-process color cathode ray tube in readiness for the bake-out cycle are depicted in FIGS. 1 and 2. To facilitate understanding of the apparatus and method according to the invention for use in the manufacture of a tension mask color cathode ray tube, a brief description of the tube is provided in the following paragraphs.

Color cathode ray tube 20 has a front assembly 22 that includes a faceplate 24. On the inner surface 26 of faceplate 24 there is a screen 28 comprising deposits of phosphor that emit red, green and blue light when activated by respective electron beams. A film of aluminum 30 is indicated as covering the screen 28. The peripheral sealing area 32 of faceplate 24 is depicted as being attached to the peripheral sealing area 33 of a funnel 34. The x-y orientation of the faceplate is indicated by the associated arrows, where x is the horizontal orientation, and y the vertical orientation.

Front assembly 22 includes four discrete shadow mask support structures comprising rails 48A, 48B, 48C and 48D that extend from the faceplate 24, and which embrace screen 28; the four rails support a flat tension mask 50. The shape of the apertures in mask 50 are indicated by the inset 52.

The anterior-posterior axis of tube 20 is indicated by reference number 56. A magnetic shield 58 is enclosed within funnel 34. High voltage for tube operation is applied to a conductive coating 60 on the inner surface of funnel 34 by way of an anode button 62 embedded in the glass of the funnel 34.

The neck 66 of tube 20 encloses a in-line electron gun 68 which provides three discrete electron beams 70, 72 and 74 for exciting respective red-light-emitting, green-light-emitting, and blue-light-emitting phosphors deposited on screen 28. A hollow glass tubulation 76 extends from the base 78 of neck 66. Glass tubulation 76 provides a channel for the evacuation of gasses from tube 20, and for the sealing of the tube when all gas is exhausted.

Figure 3:
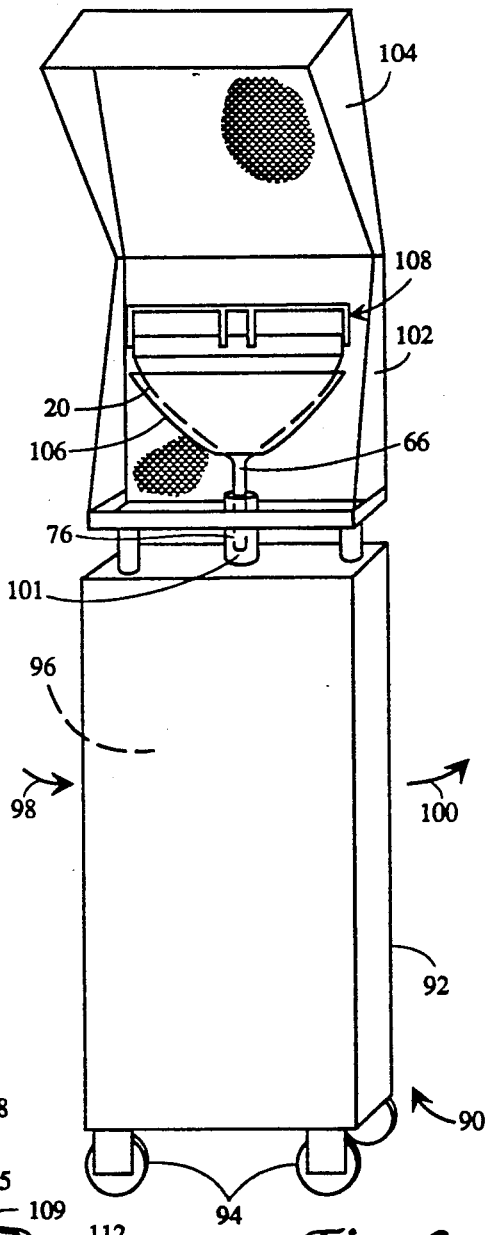
FIG. 3 is a view in elevation and in perspective of a carriage for conveying a tension mask tube through a bake-out oven, with a tube mounted on the carriage and ready for passage through the oven.

The in-process tube 20 depicted in FIG. 1 is ready for passage through a bake-out oven, which comprises an apparatus for exhausting and sealing the envelope of the tube. Tube 20 is conveyed through the oven by the carriage 90 depicted in FIG. 3; carriage 90 is typical of a train of similar carriages, each carrying an in-process tube, that are towed through the bake-out oven. Carriage 90 includes a cabinet 92 supported by wheels 94 which follow a track routed through the oven in the left-to-right direction indicated by the arrows 98 and 100. Enclosed in cabinet 90 is a vacuum pump 96, the input of which is connected to the glass tubulation 76 that extends from the base of the tube 20 for exhausting the tube. Tube 20 is supported in carriage 90 by a sleeve 101 into which the neck 66 of tube 20 is inserted, as indicated. A wire cage 102 with a hinged lid 104 closes like a clamshell to envelop confine tube 20 during its passage through the oven; if the tube should implode due to the stresses induced in the bake-out cycle, the shards of glass will be caught by cage 102.

Figure 4:
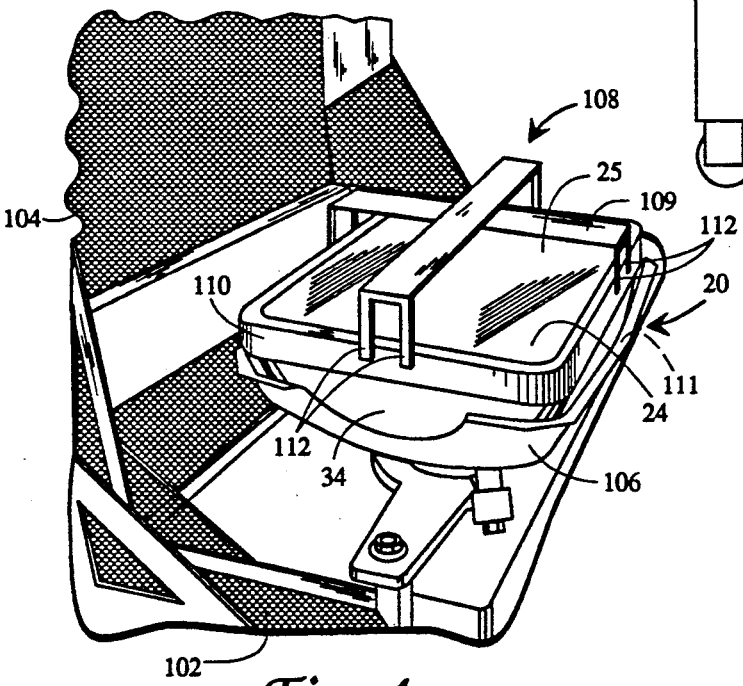
FIG. 4 is a detail view in perspective of the tube of FIG. 3 as installed on the carriage, and depicting the shielding means according to the invention mounted on the faceplate.

FIG. 4 shows in detail the status of the tube 20 as it is about to enter the bake-out oven. A heat-insulative "sock" 106 made of aluminum is shown as enclosing the funnel 34. Shielding means 108 according to the invention include a heat shield for shielding a central area of faceplate 24 from a radiant heat source located within the bake-out oven, and spaced apart from the front surface 25 of faceplate 24. Bracket 110 fits around the faceplate 24 of tube 20. Arms 112 extend from bracket 110 support the heat shield 109. The spacing of heat shield 109 apart from the front surface 25 of faceplate 24 as indicated is about two inches; the spacing may vary according to the invention from one to six inches, depending upon the shielding requirement and dimensions of the faceplate. In addition to supporting the heat shield 109 according to the invention, bracket 110 provides for the supplementary shielding of the sides of faceplate 24 from the heat of the oven to ensure a more even heating of faceplate 24. Stand-offs 111 hold the bracket 110 off the surface of the faceplate 24 to prevent the bracket from transferring heat to the faceplate edges during cooldown in the bake-out cycle.

Figure 5:
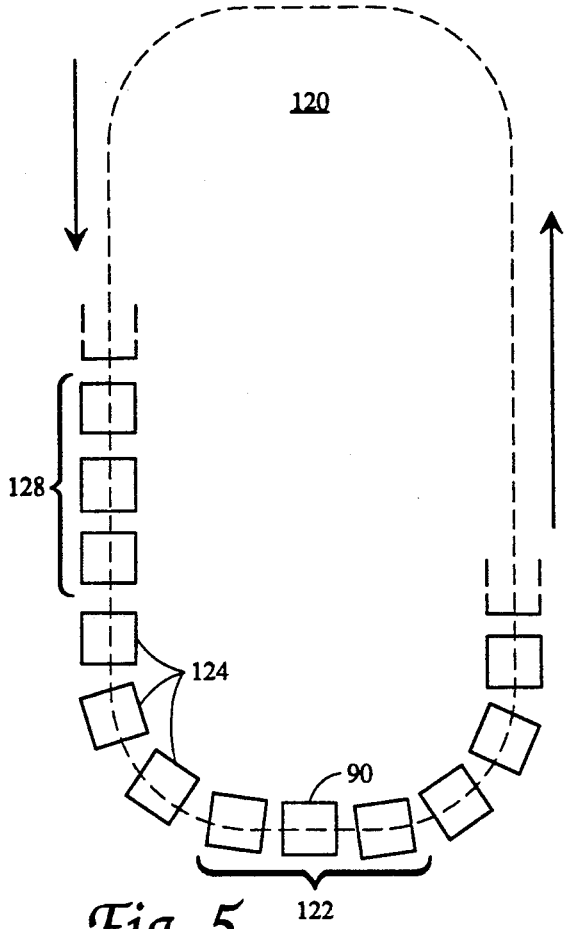
FIG. 5 is a diagrammatic representation of the route of an in-process tube through the bake-out oven.

The circuit of a tube 20 in passing through a bake-out oven 120 is indicated diagrammatically in FIG. 5. A tube that has already passed through oven 120 without imploding is unloaded from a carriage at the unloading-loading station 122, and tube 20 is loaded into carriage 90 by inserting the neck 66 of tube 20 into sleeve 101. The inlet to the vacuum pump is automatically connected to the tubulation 76. Carriage 90, and the other carriages 124, move continually during loading of the tubes, passing through the bake-out oven 120 and on to the unloading stage. In passing through the oven 120, the tubes are subjected to a temperature of about 345 degrees C. for a period of one and one-half to one and three-quarter hours.

Figure 6:
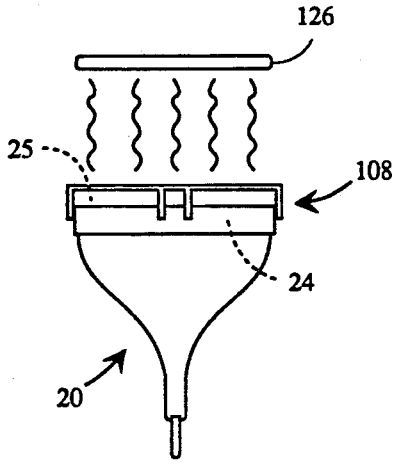
FIG. 6 is a diagrammatic view in elevation showing the relationship of the faceplate heating means, the faceplate, and the shielding means according to the invention.

FIG. 6 is a diagrammatical view that indicates the radiant heating of the faceplate of tube 20 as it passes through bake-oven 120, with shielding means 108 according to the invention in place. The front surface 25 of faceplate 24 passes within 18 to 20 inches of radiant heating elements !26 which are a part bake-out oven 120. The radiant heating elements 126 may comprise Calrod (R) units.

Figure 7:
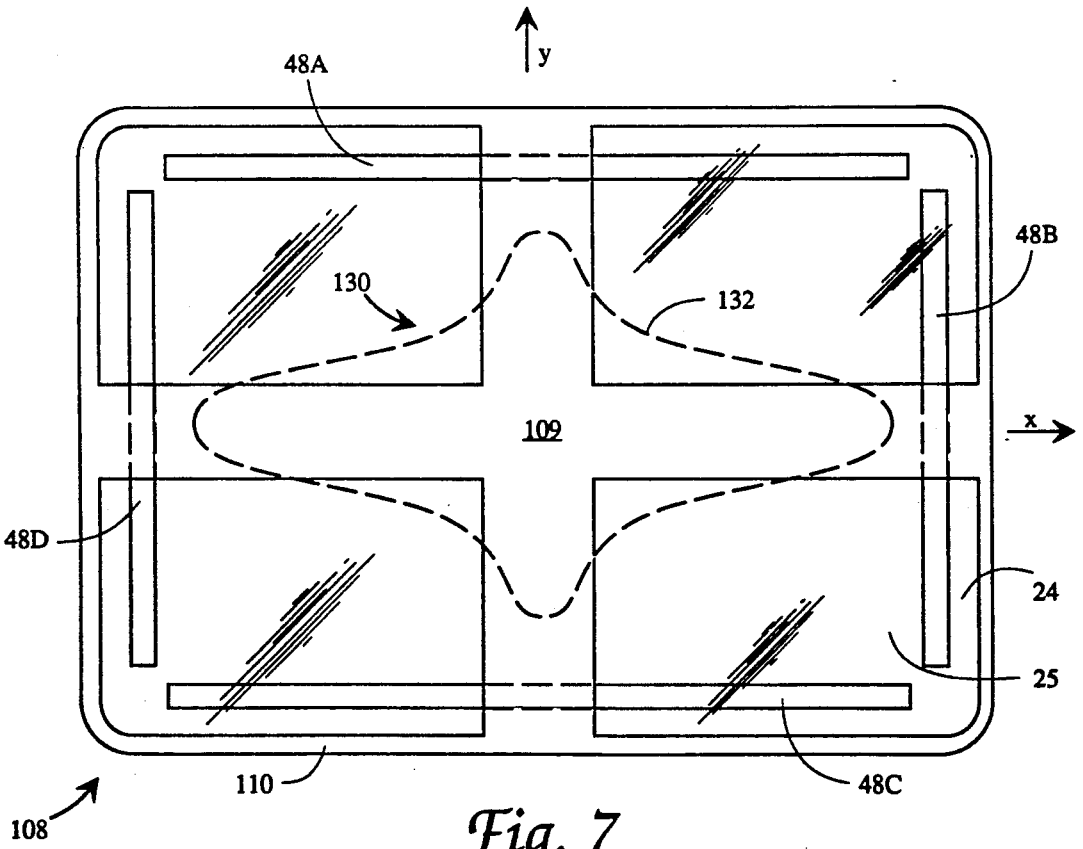
FIG. 7 is a plan view depicting a preferred embodiment of the shielding means according to the invention.

The embodiment of the shielding means 108 shown by FIG. 4 is depicted in greater detail in the plan view of FIG. 7. Bracket 110 supports heat shield 109 a predetermined distance away from the front surface 25 of faceplate 24. The rails 48A, 48B, 48C and 48D that support the tension mask 50 are shown as being visible in this view; normally, they would be concealed by the mask 50, which is not shown. The heat shield 109 of shielding means 108 is shown as being cruciform-shaped in an x-y orientation. Shielding means 108 includes a heat shield for shielding the central area 130 of faceplate 24 from the radiant heating elements 126.

After passing through the bake-out oven 120, carriage 90 enters the tipping-off stage 128. The glass of tubulation 7 is heated to its melting point by electric heaters, and the molten glass, pulled in by the vacuum in the envelope, pinches off the tubulation 76, providing for permanent sealing of the tube envelope.

It was determined that a high incidence of implosion during the bake-out cycle was due primarily to the cracking of the glass envelope as a result of wide temperature differentials between the outside surface and inside surface of the funnel. A thermal stress analysis of flat tension mask tubes under bake-out showed that it is necessary to keep the funnel of the tube cooler as the temperature rises in the oven, and warmer as the temperature falls. In short, it is necessary to maintain as low a temperature differential as possible between the outside surface and the inside surface of the funnel.

The temperature differential in the walls of the funnel was effectively lowered by enclosing the funnel in the insulative aluminum sock 106. Although the presence of the sock 106 reduced the temperature differential, its use resulted in a transfer of heat from the funnel into the faceplate. To maintain the proper temperature equilibrium, it was necessary to radiantly heat the faceplate by heating elements spaced 18 to 20 inches from the surface of the faceplate. While effective, this measure led to yet another problem during the bake-out cycle—cracking of the faceplate in the corners due to the stresses at the ends of the rails induced by the radiant heating. This problem was resolved by the present invention.

It will be noted that rails 48A, 48B, 48C and 48D are located near the sides 132 of faceplate 24. Irregularities in the glass-to-rail seal, especially at the ends of the rails, can be the source of cracks in the faceplate which can initiate a catastrophic failure of the glass of the faceplate, resulting in implosion of the tube during the bake-out cycle.

The shielding means 108 according to the invention provides for shielding the central area 130 of faceplate 24 from the radiant heat source 126. As a result, the stresses induced in the corners of the faceplate 24 at the ends of rails 48A, 48B, 48C and 48D during thermal cycling of tube 20 are dispersed in the shielded, cooler central area 130 of the faceplate 24. The approximate boundaries of the area cooled are indicated by the dashed line identified by reference number 132.

In effect, the vulnerable areas at the ends of the rails 48A, 48B, 48*c* and 48D go into compression upon heating, and the cooler central area 130, which is in tension and hence relatively stress-free, absorbs the stresses induced in the corners of the faceplate.

Bracket 110 also helps equalize the temperature of the faceplate and the tube envelope by shielding the sides 134 of faceplate 24.

The efficacy of the faceplate shielding means according to the invention is shown by the reduction of implosions from a rate of 5.84 percent to 2.26 percent.

The material from which the shielding means is fabricated preferably comprises stainless steel having a thickness of one-sixteenth of an inch.

Figure 8:
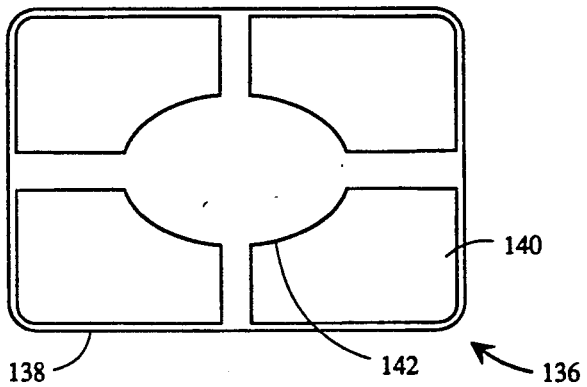
FIG. 8 is a view similar to FIG. 7 showing an alternative embodiment of faceplate shielding means according to the invention.

While a particular embodiment of the invention has been shown and described, it will be obvious to those skilled in the art that changes and modifications may be made in the inventive apparatus and method without departing from the invention in its broader aspects. An example is the embodiment depicted in FIG. 8, in which shielding means 136 includes a bracket 138 similar to bracket 110 previously described, and which fits over the underlying faceplate 140. The heat shield 142, as supported by bracket 138, is in the form of an ellipse. The aim of the appended claims is to cover all such changes and modifications as fall within the true spirit and scope of the invention.

We claim:

1. For use in the manufacture of a color cathode ray tube including a faceplate with a screen embraced by rails supporting a tensioned shadow mask, wherein the faceplate of the tube is subjected to a radiant heat source for heating said faceplate, an apparatus comprising:

shielding means for reducing stress on said cathode ray tube including a heat shield for shielding a central area of said faceplate from said radiant heat source; and a frame for overlapping said faceplate and enclosing and shielding the sides of said faceplate from heat, said frame having a plurality of arms for spacing the heat shield apart from the front surface of said faceplate;

whereby stresses induced in the corners of said faceplate by said rails during thermal cycling of the tube are dispersed in a shielded, cooler central area of said faceplate.

2. The apparatus according to claim 1 wherein said heat shield of said shielding means is cruciform-shaped in an x-y orientation.

3. The apparatus according to claim 1 wherein said heat shield of said shielding means is in the shape of an ellipse.

4. For use in the manufacture of a color cathode ray tube including a faceplate with a screen embraced by rails supporting a tensioned shadow mask, an apparatus for exhausting and sealing the envelope of said tube, comprising:

a bake-out oven;

a carriage for conveying the tube through said oven;

vacuum pump means connected to said tube for exhausting said tube;

a radiant heat source spaced apart from said faceplate for the direct heating of said faceplate;

shielding means for reducing stress on said cathode ray tube including a heat shield for shielding a central area of said faceplate from said radiant heat source;

means for sealing said tube when said tube is exhausted;

whereby stresses induced in the corners of said faceplate by the presence of said rails during thermal cycling of said tube are dispersed in a shielded, cooler central area of said faceplate.

5. A method for exhausting and sealing the envelope of a color cathode ray tube having a faceplate with a screen embraced by rails supporting a tensed foil shadow mask, comprising:

mounting said tube on the moving carriage of a bake-out oven;

pumping the gasses from said envelope;

heating said faceplate with a radiant heat source;

shielding a central area of said faceplate from said radiant heat source; and sealing said envelope, whereby shielding of a central area of said faceplate disperses stresses induced in the corners of said faceplate by the presence of said rails.

* * * * *